US006270914B1

(12) United States Patent
Ogasawara et al.

(10) Patent No.: US 6,270,914 B1
(45) Date of Patent: Aug. 7, 2001

(54) SURFACE-HARDENED TITANIUM MATERIAL, SURFACE HARDENING METHOD OF TITANIUM MATERIAL, WATCHCASE DECORATION ARTICLE, AND DECORATION ARTICLE

(75) Inventors: Naoto Ogasawara, Iruma; Yasumasa Kusano, Tokorozawa; Shizue Itoh, Hoya; Kotaro Ishiyama, Yono, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/068,346

(22) PCT Filed: Nov. 8, 1996

(86) PCT No.: PCT/JP96/03285

§ 371 Date: Nov. 10, 1998

§ 102(e) Date: Nov. 10, 1998

(87) PCT Pub. No.: WO97/17479

PCT Pub. Date: May 15, 1997

(30) Foreign Application Priority Data

Nov. 8, 1995 (JP) ..... 7-289601
May 13, 1996 (JP) ..... 8-117499

(51) Int. Cl.[7] ..... C23C 10/28

(52) U.S. Cl. ..... 428/610; 428/651; 428/660; 428/632; 148/512; 148/513; 148/DIG. 33; 148/421

(58) Field of Search ..... 428/610, 660, 428/651, 941, 632; 148/512, 513, 421, DIG. 33

(56) References Cited

U.S. PATENT DOCUMENTS 4,936,927 6/1990 Grunke et al. .

FOREIGN PATENT DOCUMENTS 42 22 211 C 1 7/1993 (DE) .
50-29437 3/1975 (JP) .
56-146875 11/1981 (JP) .
63-190158 8/1988 (JP) .
63-195258 8/1988 (JP) .
2-181005 7/1990 (JP) .
2-250951 10/1990 (JP) .
3-219065 9/1991 (JP) .
3-249168 11/1991 (JP) .
3-271355 12/1991 (JP) .
5-48296 7/1993 (JP) .
6-93412 4/1994 (JP) .
813055A * 1/1996 (JP) .

* cited by examiner

*Primary Examiner*—Deborah Jones
*Assistant Examiner*—Jennifer McNeil
(74) *Attorney, Agent, or Firm*—Armstrong, Westerman, Hattori, McLeland & Naughton, LLP

(57) ABSTRACT

The invention provides a method of surface hardening a titanium material wherein titanium-aluminum alloy powders or aluminum oxide powders are brought into contact with the surface of the titanium material, and a heat treatment is applied thereto, causing aluminum contained in the powders to be diffused in the surface of the titanium material so that intermetallic compounds such as $Ti_3Al$, TiAl, and the like are formed inmediately underneath the surface of the titanium material, thereby enhancing surface hardness without causing surface exfoliation. The invention also provides a surface-hardened titanium-base material, and decorative articles and watchcases, composed of the surface-hardened titanium-base material, which are substantially impervious to scratches, and not prone to cause metallic allergy.

4 Claims, 1 Drawing Sheet

SURFACE-HARDENED TITANIUM MATERIAL, SURFACE HARDENING METHOD OF TITANIUM MATERIAL, WATCHCASE DECORATION ARTICLE, AND DECORATION ARTICLE

TECHNICAL FIELD

The present invention relates to a surface-hardened titanium-base material produced by enhancing the surface hardness of a titanium material, which is suited particularly for use in decorative articles (accessories) and watchcases, to be worn by users, and a method of surface hardening the titanium material to obtain the same.

BACKGROUND TECHNOLOGY

Conventional materials composed mainly of titanium have been prone to be easily scratched on the surface thereof owing to low hardness, and have insufficient wear resistance. As a result, in the case of using a pure titanium material, for example, for a watchcase, it has been difficult to enable the watchcase to maintain a high quality external appearance for a long duration. Accordingly, various methods of surface hardening a titanium material have been under intense study.

Conventional methods of surface hardening a titanium material include a method of applying an oxidation or nitriding to the surface thereof. However, these methods have drawbacks in that the oxide layer or nitride layer formed thereby was prone to be easily exfoliated as the same was very brittle and had low impact resistance. Although there is another method of applying high hardness chromium plating to the surface of a titanium material, this method entailed a problem of effluent disposal.

In Japanese Patent Application Laid-open No. 2-250951, a method of surface hardening a titanium material has been proposed wherein nickel (Ni), iron (Fe), cobalt (Co), or the like is placed on the surface of the titanium material, and heated to a temperature higher than a eutectic point of the respective metal with titanium (Ti).

However, as a liquid phase emerges in this method, difficulties will be encountered in removing reaction products remaining on the surface of a surface-hardened titanium-base material during post-treatment processing. Furthermore, in the case where the titanium material thus obtained is used for decorative articles (accessories) or for a watchcase to be worn by a user, there has arisen a risk of residual nickel, iron, cobalt, or the like present the metal surface causing metallic allergy to the skin of the user because the skin will come in direct contact with the surface-hardened titanium-base material. Otherwise, in Japanese Patent Application Laid-open No. 56-146875, a method of enhancing the surface hardness and erosion resistance of a titanium material has been proposed wherein the titanium material is immersed in aluminum oxide ($Al_2O_3$) powders, heated, and held in an atmosphere such that a hardened oxidized layer and a dense layer of nitrogen in a solid solution state underneath the hardened oxidized layer are formed in the surface of the titanium material.

However, with this method intended to form a hardened oxidized layer on the surface of a titanium material, it is difficult to control the thickness of the hardened titanium oxide layer formed on the surface and the amount of oxygen in solid solution because intense oxidation caused by oxygen in the atmosphere occurs in spite of the presence of the aluminum oxide powders around the titanium material since heating is applied in the atmosphere. Therefore, there has been a risk of exfoliation occurring due to an increase in the thickness of the hardened titanium oxide layer, and brittle degradation of the titanium material due to an increase in the amount of oxygen in solid solution can occur.

In addition, with the method, uneven contact between the aluminum oxide powders and the titanium material resulted due to the use of aluminum oxide powders not less than 50 $\mu$m in grain size, causing another problem that the hardened layer was formed in spots on the surface, and became a porous hardened layer which was prone to be easily exfoliated.

Then, in Japanese Patent Application Laid-open No. 63-195258, a method of enhancing the surface hardness of a titanium material has been proposed wherein the titanium material is introduced into a vessel filled up with calcium carbonate ($CaCO_3$) powders, the vessel is closed after a partial pressure of oxygen is reduced to not higher than $10^{-2}$ atm, and is heated to a temperature in the range of 900 to 1200° C., causing a carburized layer and an oxygen diffused layer to be formed on the surface of the titanium material by maintaining the temperature.

However, with this method wherein a porous calcium oxide (CaO) layer is formed in the surface besides the carburized layer and oxygen diffused layer, the natural metallic color of the titanium material is lost.

Also, since the treatment temperature was set at 900° C. or more, there was a possibility of this method causing in effect growth of crystal grains, resulting in degradation of quality and high surface roughness. Additionally, the method, wherein a gas resulting from thermal decomposition of calcium carbonate powders is utilized, has had other problems, for example, difficulty with producing stable products safely and efficiently on an industrial basis unless meticulous care is exercised to control the amount of calcium carbonate powders fed relative to the amount of titanium material supplied and the construction and pressure resistant design of the vessel used in the process.

The present invention has been developed to solve various problems described in the foregoing, and an object of the invention is to provide a surface-hardened titanium-base material, capable of preventing exfoliation of the surface layer thereof, having uniformly enhanced surface hardness and wear resistance, unsusceptible to scratches, and not prone to cause metallic allergy. It is another object of the invention to provide a method of surface hardening a titanium material to produce the surface-hardened titanium-base material, and still another object of the invention is to provide products using the surface-hardened titanium-base material.

DISCLOSURE OF THE INVENTION

In order to achieve one of the objects of the invention described in the foregoing, in a surface-hardened titanium-base material according to the invention, a first phase composed of TiAl, a second phase composed of TiAl and $Ti_3Al$, a third phase composed of $Ti_3Al$, and a fourth phase composed of $Ti_3Al$ and Ti are formed immediately underneath the surface of a pure titanium material, sequentially from the surface towards the interior zone thereof such that a percentage of aluminum in relation to pure titanium declines sequentially by a gradient from the surface towards the interior zone of the pure titanium material.

Alternatively, a first phase composed of TiAl, a second phase composed of TiAl and $Ti_3Al$, a third phase composed of $Ti_3Al$, and a fourth phase composed of $Ti_3Al$ and Ti are formed immediately underneath the surface of a pure titanium material, sequentially from the surface towards the interior zone thereof such that a percentage of aluminum in relation to pure titanium declines sequentially by a gradient from the surface to an intenor zone of the pure titanium material, and oxygen concentration also declined sequentially by gradient from the surface to the interior zone of the pure titanium material.

In a method of surface hardening a titanium material according to the invention, titanium-aluminum alloy powders only are brought into contact with the surface of the pure titanium material, and a heat treatment is applied thereto, forming the first phase composed of TiAl, the second phase composed of TiAl and $Ti_3Al$, the third phase composed of $Ti_3Al$, and the fourth phase composed of $Ti_3Al$. and Ti immediately underneath the surface of the pure titanium material, sequentially from the surface towards the interior zone thereof such that a percentage of aluminum in relation to pure titanium is caused to decline sequentially by a gradient from the surface to the interior zone of the pure titanium material.

In this case, it is preferable that the titanium-aluminum alloy powders brought into contact with the surface of the pure titanium material contain not lower than 30 at % (atom percent) but not higher than 70 at % of aluminum.

Also, the average grain size of the titanium-aluminum alloy powders brought into contact with the surface of the titanium material is preferably not greater than 30 $\mu$m.

Further, a heating temperature is preferably in the range of 800 to 900° C.

In another method of surface hardening a titanium material according to the invention, aluminum oxide ($Al_2O_3$) powders only may be brought into contact with the surface of the pure titanium material, and a heat treatment may be applied thereto, forming the first phase composed of TiAl, the second phase composed of TiAl and $Ti_3Al$ the third phase composed of $Ti_3Al$, and the fourth phase composed of $Ti_3Al$ and Ti immediately underneath the surface of the pure titanium material, sequentially from the surface towards the interior zone thereof, such that a percentage of aluminum in relation to pure titanium declines sequentially by a gradient from the surface to an interior zone of the pure titanium material, and oxygen concentration also declined sequentially by gradient from the surface to the interior zone of the pure titanium material.

With this method, the aluminum oxide powders described above serve as a source of supply of aluminum and oxygen for forming the titanium-aluminum (Ti—Al) based intermetallic compounds in the surface of the titanium material such that a percentage of aluminum and oxygen concentration, respectively, in relation to titanium declines by a gradient from the surface to the interior zone of the titanium material.

In this case, for an atmosphere during the heat treatment, a reduced pressure atmosphere, or an inert atmosphere such as argon (Ar) gas, helium (He) gas, or the like, is preferable.

The average grain size of the aluminum oxide powders to be brought into contact with the surface of the titanium material is preferably in the range of 0.1 to 50 $\mu$m. Further, use of aluminum oxide powders having a particle size distribution with a wider half width is preferable provided that the average grain size remains the same. Furthermore, a particle size distribution thereof similar to the normal distribution is more preferable.

It is also desirable that the heating temperature is not higher than a sintering initiation temperature of the aluminum oxide powders.

The surface-hardened titanium-base material according to the invention is suitable for use as a material for accessories such as necklaces, earrings, and the like, and the claddings of watchcases, and the like.

BEST MODE FOR CARRYING OUT THE INVENTION

Next, embodiments of the invention will be described in detail. First embodiment of a surface-hardened titanium-base material according to the invention The first embodiment of the invention is a surface-hardened titanium-base material wherein titanium-aluminum based intermetallic compounds are formed immediately underneath the surface of a pure titanium material such that the concentration of aluminum contained in the respective compounds declines by a gradient from the surface towards the interior zone of the titanium material.

Figure 1:
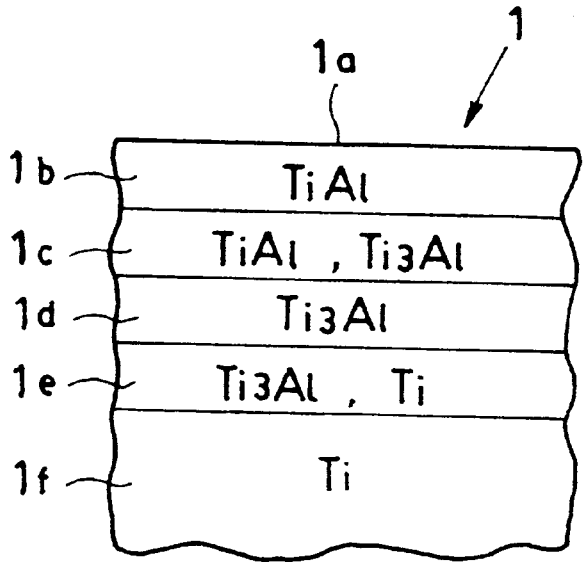
FIG. 1 is an enlarged schematic illustration showing a first embodiment of a surface-hardened titanium-base material according to the invention, immediately under the surface thereof.

That is, as shown in FIG. 1, in the surface-hardened titanium-base material 1, a plurality of different titanium-aluminum based intermetallic compound phases are formed in the subsurface zone of the pure titanium material as denoted, respectively, by 1*b*, 1*c*, 1*d*, and 1*e*, from the surface 1*a* towards the interior zone 1*f*.

The first phase 1*b* is composed of TiAl with the highest percentage of aluminum contained therein. The second phase 1*c* is composed of TiAl and $Ti_3Al$, with the second highest percentage of aluminum. The third phase 1*d* is composed of $Ti_3Al$ with a percentage of aluminum lower than that in the second phase 1*c*. The fourth phase 1*e* is composed of $Ti_3Al$ and Ti, with its percentage of aluminum at the lowest. The interior zone 1*f* underneath the fourth phase 1*e* is composed of pure titanium (Ti).

The respective titanium-aluminum based intermetallic compound phases, 1*b*, 1*c*, 1*d*, and 1*e*, are not distinctly distinguishable, but vary continuously and are formed such that the percentage of aluminum content relative to Ti content declines by a gradient from the surface 1*a* towards the interior zone 1*f*.

The surface-hardened titanium-base material described above will have a dramatically enhanced surface hardness because the surface 1*a* is turned into the TiAl phase. Furthermore, as there is no abrupt change in the property of the material immediately underneath the surface thereof, exfoliation does not occur on the surface, and the TiAl phase composing the surface 1*a*, even if coming in contact with the skin of a user, is not prone to cause metallic allergy to the skin.

First embodiment of a method of surface-hardening a titanium material In a first embodiment of a method of surface-hardening a titanium material according to the invention, titanium-aluminum (Ti—Al) alloy powders only are brought into contact with the surface of a pure titanium material, and heated, causing titanium and aluminum contained 9*d* in the Ti—Al alloy powders to be diffused by a gradient from the surface of the titanium material towards the interior zone thereof so that the titanium-aluminum based intermetallic compound phases consisting of the first phase 1*b* through the fourth phase 1*e* sequentially as shown in FIG. 1 are formed immediately underneath the surface of the titanium material in such a manner as to cause the percentage of aluminum to be reduced in sequentially by a gradient from the surface of the titanium material towards the interior zone thereof.

With this method, the surface-hardened titanium-base material described in the foregoing can be produced.

When the percentage of aluminum present immediately underneath the surface of the titanium material is increased by raising a heat treatment temperature or extending a heating time, intermetallic compounds such as $Ti_3Al$ phase, TiAl phase, and the like are formed of aluminum in a solid solution state within the titanium, increasing surface hardness dramatically.

Also, as the percentage of aluminum present immediately underneath the surface of the titanium material can be raised by increasing the amount of aluminum in the composition of the Ti—Al alloy powders, phases occuring immediately underneath the surface of the titanium material can be controlled according to the composition of the Ti—Al alloy powders.

In this connection, if aluminum powders not containing titanium are brought into contact with the surface of the titanium material in place of the Ti—Al alloy powders, this will place restrictions on a heating temperature owing to the relatively low melting point of the aluminum powders, which is about 660° C., making it impossible to form a sufficiently hardened layer.

On the other hand, if a heat treatment is applied to the aluminum powders at a temperature not lower than the melting point thereof, it will be extremely difficult to remove molten aluminum from the titanium material after the heat treatment.

Accordingly, a heat treatment using Ti—Al alloy powders having a high melting point can be applied at a higher temperature than a heating temperature when only aluminum powders are in use. Further, intermetallic compound phases are formed with greater ease by use of aluminum, which is an a stabilization element, in comparison with β stabilization elements such as iron (Fe), niobium (Nb), chromium (Cr), and the like.

The preferable condition for the heat treatment is that a heating temperature falls in the range of 800 to 900° C. Heat treatment applied at lower than 800° C. will result in insufficient diffusion of aluminum towards the surface of the titanium material, and a $Ti_3Al$ phase may not occur. Meanwhile, if the heating temperature exceeds 900° C., sintering of the Ti—Al alloy powders will proceed, and problems will be encountered in the removal of the sintered Ti—Al alloy powders after the heat treatment.

An atmosphere under which the heat treatment is applied may preferably be a reduced pressure atmosphere which is very close to a vacuum state, or an inert gas atmosphere such as argon gas, helium gas, or the like.

With reference to the composition of the Ti—Al alloy powders to be used, the Ti—Al alloy powders containing a minimum of 30 at % of aluminum is preferable taking into account the diffusion of aluminum to the surface of the titanium material. If the percentage of aluminum is lower than that, the diffusion of aluminum to the surface of the titanium material will be insufficient, and a $Ti_3Al$ phase does not occur, failing to achieve satisfactory surface hardening. Furthermore, sintering of the Ti—Al alloy powders will proceed during the heat treatment due to presence of the a phase in the heat treatment temperature region, and it will become difficult to remove the Ti—Al alloy powders adhering to the surface of the titanium material after the heat treatment. On the other hand, if the percentage of aluminum exceeds 80 at %, a liquid phase will occur at low temperatures, placing restrictions on the heating temperature. Therefore, this is not preferable.

The average grain size of the Ti—Al alloy powders used in the heat treatment is preferably not greater than 30 μm in diameter. In the case where the heat treatment is applied using the Ti—Al alloy powders 50 μm in average grain size, an area of contact between the surface of the titanium material to be treated and the Ti—Al alloy powders is decreased, limiting the diffusion of aluminum in the Ti—Al alloy powders to the surface of the titanium material, and resulting in a decrease in formation of the intermetallic compound phases. As a result, a noticeable increase in the surface hardness cannot be attained.

With reference to metals that cause allergic effects to human skin, a metal existing in the form of an intermetallic compound is generally less likely to cause allergy than a metal existing in the form of a simple substance, composed of an element. For example, aluminum too is less likely to cause allergy when it is present in the form of an intermetallic compound combined with another metal than when it is present in the form of a simple substance. Hence, the surface-hardened titanium-base material according to the invention wherein the Ti—Al based intermetallic compounds are formed in the surface of the pure titanium material is suitable as a material for decorative articles such as necklaces, earrings, and the like, or the watchcases, which often come into contact with a users' skin.

Now, concrete working examples of the first embodiment described above and comparative examples of the same for the purpose of comparing effects thereof with those of the respective working examples are given hereinafter.

Working Example 1

The surface of a pure sintered titanium material columnar in shape of ∠10 ×1.5 mm (diameter: 10 mm, height: 1.5 mm) was buffed using aluminum oxide powders 0.05 μm in grain size as abrasives to obtain a mirror-like finished surface and the pure sintered titanium material with the obtained surface was covered with Ti—Al alloy powders (the concentration percentage of aluminum: 50 at %) 10 μm in average grain size.

A surface-hardened titanium-base material was produced by setting the pure titanium material in such a state as described above in a high temperature furnace with a vacuum atmosphere, heating the same at a heating rate of 10° C./min, and cooling the same at a cooling rate of 5° C./min after holding a heat treatment temperature at 800° C. for two hours. An pressure during the heat treatment was at $10^{-4}$ to $10^{-5}$ torr.

Working Example 2

A surface-hardened titanium-base material was produced in the same manner as for working example 1, except that the heat treatment temperature was changed to 850° C.

Working Example 3

A surface-hardened titanium-base material was produced in the same manner as for working example 1, except that the heat treatment temperature was changed to 900° C.

Working Example 4

A surface-hardened titanium-base material was produced in the same manner as for working example 1, except that the concentration percentage of aluminum in the Ti—Al alloy powders was changed to 40 at %.

Working Example 5

A surface-hardened titanium-base material was produced in the same manner as for working example 4, except that the heat treatment temperature was changed to 850° C.

Working Example 6

A surface-hardened titanium-base material was produced in the same manner as for working example 1, except that the concentration percentage of aluminum in the Ti—Al alloy powders was changed to 45 at %.

Working Example 7

A surface-hardened titanium-base material was produced in the same manner as for working example 6, except that the heat treatment temperature was changed to 850° C.

Working Example 8

A surface-hardened titanium-base material was produced in the same manner as for working example 2, except that the concentration percentage of aluminum in the Ti—Al alloy powders was changed to 30 at %.

Working Example 9

A surface-hardened titanium-base material was produced in the same manner as for working example 2, except that the concentration percentage of aluminum in the Ti—Al alloy powders was changed to 70 at %.

Working Example 10

A surface-hardened titanium-base material was produced in the same manner as for working example 2, except that the average grain size of the Ti—Al alloy powders was changed to 30$\mu$m.

Comparative Example 1

A surface-hardened titanium-base material was produced in the same manner as for working example 2, except that the concentration percentage of aluminum in the Ti—Al alloy powders was changed to 15 at %.

Comparative Example 2

A surface-hardened titanium-base material was produced in the same manner as for working example 2, except that the concentration percentage of aluminum in the Ti—Al alloy powders was changed to 80 at %.

Comparative Example 3

A surface-hardened titanium-base material was produced in the same manner as for working example 2, except that the average grain size of the Ti—Al alloy powders was changed to 50 $\mu$m.

Comparative Example 4

A surface-hardened titanium-base material was produced in the same manner as for working example 1, except that the heat treatment temperature was changed to 600° C.

Comparative Example 5

A surface-hardened titanium-base material was produced in the same manner as for working example 1, except that the heat treatment temperature was changed to 950° C.

Comparative Example 6

The same measurements as those taken of the aforesaid working examples and other comparative examples were taken of the sintered titanium material with the mirror-like finished surface before being brought into contact with the Ti—Al alloy powders (that is, the sintered titanium material before the surface hardening treatment was applied thereto).

The surface hardness of the surface-hardened titanium-base material produced according to working examples 1 to 10, respectively, and comparative examples 1 to 5, respectively, as well as that of the sintered titanium material before the surface hardening treatment was applied as referred to under comparative example 6 were measured by use of a Vickers hardness tester operating under a load of 50 gf. Also, a scratch test was conducted on the surfaces of all the titanium materials described above using a scratch tester equipped with a diamond penetrator of $\phi$0.05 mm×90° operated at a table feed rate of 75 mm/min and under a load of 50 gf to take measurements of the width of respective scratches. The results of respective measurements are shown in Table 1Further, the surfaces of the surface-hardened titanium materials were examined by X-ray diffraction to identify phases formed in the respective surfaces.

As shown in Table 1, it was found that pronounced improvement in Vickers hardness of the surface is achieved by applying the surface treatment according to working examples 1 to 10, respectively, as compared with the cases of comparative examples 1 to 6, and the width of a scratch after the scratch test conducted on the surface of working examples 1 to 10, respectively, is narrower than that on the surface of comparative examples 1 to 6, respectively, indicating that the surfaces of the working examples are virtually impervious to scratches.

It has also been observed that the Vickers hardness of the surfaces becomes higher, and the width of each scratch narrower, as the heat treatment temperature increases. It is deemed from the results of X-ray diffraction on the surfaces of the surface-hardened titanium-base materials that this is due to an increase in the amount of one of the intermetallic compounds formed, a $Ti_3Al$ phase which is harder than Ti. It has also been confirmed from the results of X-ray diffraction on the surface of the surface-hardened titanium-base material according to working example 9 that a TiAl phase besides the $Ti_3Al$ phase was at the diffraction peak.

In the case of comparative example 1 where the Ti—Al alloy powders containing 15 at %. aluminum was used, an increase in the surface hardness was found to be slight due to insufficient diffusion of aluminum from the alloy powders. Further, according to the results of the X-ray diffraction, a $Ti_3Al$ phase was not observed, but the sintering of the Ti—Al alloy powders was found have already started.

The results of the surface hardening treatment applied with the alloy powders according to comparative example 2 show that both the Vickers hardness test and scratch test could not be conducted to the surface of the surface-hardened titanium-base material due to occurrence of a liquid phase after the heat treatment was applied owing to an excessively high percentage of aluminum concentration in the Ti—Al alloy powders.

In the case of comparative example 3 where the surface hardening treatment was applied using Ti—Al alloy powders 50 μm in average grain size, and containing 50 at % of aluminum, the Vickers hardness was found to be lower than Hv 400, and the width of a scratch was not much different from that of the case of comparative example 6 where the surface hardening treatment was not applied, indicating failure to obtain sufficient scratch resistance.

In the case of comparative example 4 where the surface hardening treatment was applied at the heat treatment temperature of 600° C., formation of a $Ti_3Al$ phase was hardly noticeable, and both enhancement in Vickers hardness of the surface of the titanium material and reduction in the width of each scratch were not noticeably observed.

In the case of comparative example 5 where the heat treatment temperature was raised to 950° C., sintering of the Ti—Al alloy powders proceeded, and removal of the Ti—Al alloy powders adhering to the surface of the titanium material after heat treated became difficult so that both the Vickers hardness test and scratch test could not be conducted.

With reference to the surface-hardened titanium-base material produced according to any of working examples described in the foregoing, neither cracking nor exfoliation of the surface thereof was observed through visual inspection of scratch marks conducted after the scratch test.

Figure 2:
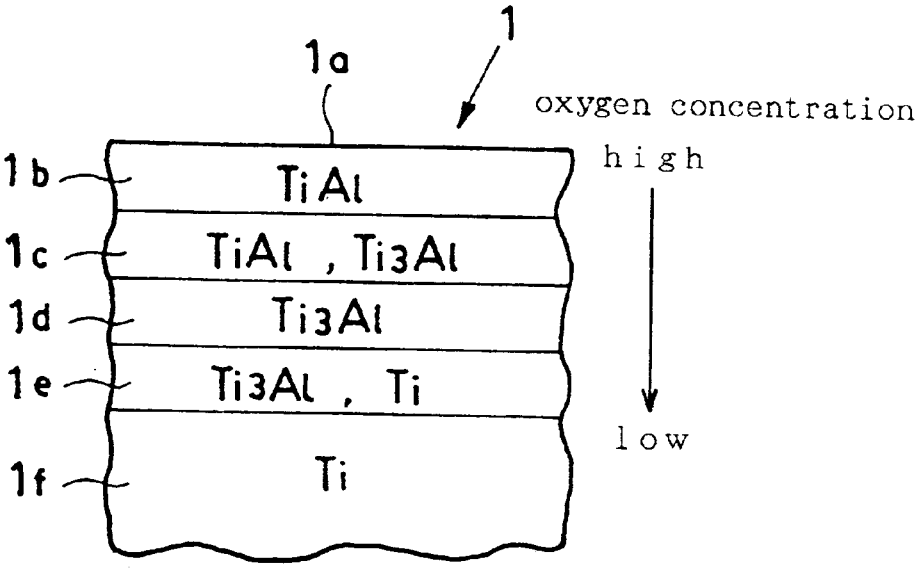
FIG. 2 is an enlarged schematic illustration showing a second embodiment of a surface-hardened titanium-base material according to the invention, immediately under the surface thereof, wherein a percentage of oxygen concentration (O) varying by a gradient is present, in addition to the first embodiment.

Second embodiment of a surface-hardened titanium-base material according to the invention FIG. 2 shows the second embodiment of the surface-hardened titanium-base material according to the invention. In the surface-hardened titanium-base material 1, a plurality of different phases, 1*b* through 1*e*, of titanium-aluminum based intermetallic compound phases (TiAl, $Ti_3Al$, and the like) are formed sequentially immediately underneath the surface 1*a* of a pure titanium material in the same manner as the case of the first embodiment of the invention shown in FIG. 1. However, in this case, these phases are formed such that the percentage of aluminum in relation to pure titanium and oxygen (O) concentration, declines sequentially by a gradient from the surface 1*a* towards the interior zone 1*f*, which is the pure titanium material.

With the surface-hardened titanium-base material according to this embodiment as well, surface hardness is dramatically enhanced similarly to the case of the first embodiment of the surface-hardened titanium-base material according to the invention. Furthermore, the surface hardness is further enhanced due to an additional effect of solid solution hardening by the agency of oxygen. As there is no abrupt change in the properties of substances present immediately underneath the surface of the material, exfoliation of the surface will not occur.

Further, as Ti or Al is not present in the surface as an element in the form of a simple substance, but present in the form of intermetallic compounds, there will be little risk of the surface-hardened titanium-base material causing metallic allergy. Hence, the surface-hardened titanium-base material is suited for use as material for decorative articles (accessories) such as necklaces, earrings, and the like, or watchcases, and the like, that will frequently come to be in contact with human skin.

Second embodiment of a method of surface hardening a titanium material

In the second embodiment of the method of surface hardening a titanium material according to the invention, aluminum and oxygen contained in aluminum oxide ($Al_2O_3$) powders are caused to be diffused in a gradient from the surface of a pure titanium material towards the interior zone thereof by bringing only the aluminum oxide powders in contact with the surface of the pure titanium material, and by heating the same, thereby causing solid solution hardening of aluminum and oxygen, and enhancing surface hardness.

Further, when the percentage of aluminum present immediately underneath the surface of the titanium material is increased by raising a heating temperature or extending a beating time, intermetallic compounds such a $Ti_3Al$ phase, TiAl phase, and the like are formed according to the solid solution condition of aluminum in titanium, increasing the surface hardness dramatically. In other words, the surface-hardened titanium-base material 1 according to the second embodiment of the invention as illustrated in FIG. 2 can thus be produced.

In this connection, if aluminum powders not containing oxygen are brought into contact with the surface of the titanium material in place of the aluminum oxide powders, this will place restrictions on the heating temperature owing to the relatively low melting point of the aluminum powders, which is about 660° C., and then, a sufficiently hardened layer cannot be obtained.

Further, if heat treatment is applied at a temperature not lower than the melting point of the aluminum powders, it will be extremely difficult to remove molten aluminum formed from the surface-hardened titanium-base material after the heat treatment so that the object of the invention cannot be attained.

Accordingly, liquid phase diffusion reaction of aluminum is avoided by use of aluminum oxide powders having a higher melting point, and enhancement in surface hardness can be promoted by attaining a solid phase diffusion reaction of aluminum at a higher temperature.

Also, it is easier to form intermetallic compound phases with aluminum, which is an a stabilization element, than with β stabilization elements such as iron, niobium, chromium, and the like.

Now, a heating temperature not higher than the sintering initiation temperature of the aluminum oxide powders to be used is preferable. However, since the sintering initiation temperature vanes depending on the grain size of the aluminum oxide powders, the heating temperature may be determined as appropriate.

With the grain size (described hereinafter) of the aluminum oxide powders, adopted in carrying out this embodiment, the heating temperature may preferably be in the range of 800 to 900° C. A $Ti_3Al$ phase may not be formed at a heating temperature not higher than 800° C. due to insufficient division transfer of aluminum to the surface of the titanium material while the probability of the aluminum oxide powders undergoing sintering becomes higher as the heating temperature exceeds 900° C., and difficulty will be encountered in removal of the aluminum oxide powders after completion of the heat treatment.

For an atmosphere during the heat treatment, a reduced-pressure atmosphere of an inert gas such as argon gas, helium gas, or the like are preferable. Further, the background gas for use during pressure reduction, and the argon gas, helium gas, or the like, are preferably to have a dew point controlled at a given level. This is because if the dew point of a gas is not at a constant level, it will become difficult to control the amount of oxygen transferred to the titanium material at a constant level, making it difficult to obtain products with a constant surface hardness on an industrial scale.

The average grain size of the aluminum oxide powders for use in the heat treatment is preferably in the ranged of 0.1 to 50 μm. Further, aluminum oxide powders having a particle size distribution with a wider half width is preferable provided that the average grain size remains the same. Furthermore, aluminum oxide powders having a particle size distribution similar to the normal distribution is more preferable.

In the case where the heat treatment is applied using the aluminum oxide powders not less than 50 μm in average grain size, an area of contact between the surface of the titanium material to be treated and the aluminum oxide powders is reduced, limiting diffusion of aluminum in the aluminum oxide powders into the surface of the titanium material. As a result, formation of the intermetallic compound phases will become poor, and it will be difficult to increase the surface hardness evenly.

Also, in the case that the heat treatment is applied using aluminum oxide powders not more than 0.1 μm in average grain size, a bulk density becomes greater, and treatment atmosphere layers (voids) will be created between the surface of the titanium material and the aluminum oxide powders. Consequently, an area of contact between the surface of the titanium material to be treated and the aluminum oxide powders is reduced as well, limiting diffusion of aluminum in the aluminum oxide powders into the surface of the titanium material. As a result, formation of the intermetallic compound phases will become poor, and it will become difficult to increase the surface hardness evenly.

It is possible to facilitate diffusion of aluminum into the surface of the titanium material by adopting a countermeasure whereby the contact area is enlarged by pulverizing aluminum oxide powders present on the surface of the titanium material under a given pressure. However, such a countermeasure involves an increase in the number of processing steps and is not advantageous as an industrial manner.

Now, concrete working examples of the second embodiment described above and comparative examples of the same for the purpose of comparing effects thereof with those of the respective working examples are given hereinafter.

Working Example 1

The surface of a pure titanium material columnar in shape of ϕ10×1.5 mm (diameter: 10 mm, height: 1.5 mm) was buffed using aluminum oxide powders 0.05 μm in grain size as abrasives, and the pure titanium material with a mirror-like finished surface thus obtained was covered with aluminum oxide ($Al_2O_3$) powders 1 μm in average grain size.

A surface-hardened titanium-base material was produced by setting the pure titanium material in such a state as described in a high temperature furnace, heating the same at a heating rate of 10° C./min after reducing the pressure in the furnace, and then, cooling the same at a cooling rate of 5° C./min after holding a heat treatment temperature at 800° C. for two hours. The pressure during the heat treatment was controlled at to $10^{-4}$ to $10^{-5}$ torr.

Working Example 2

A surface-hardened titanium-base material was produced in the same manner as for working example 1, except that the heat treatment temperature was changed to 850° C.

Working Example 3

A surface-hardened titanium-base material was produced in the same manner as for working example 1, except that the heat treatment temperature was changed to 900° C.

Working Example 4

A surface-hardened titanium-base material was produced in the same manner as for working example 2, except that the heat treatment time (length of time during which the heat treatment temperature is maintained) was changed to four hours.

Working Example 5

A surface-hardened titanium-base material was produced in the same manner as for working example 2, except that the heat treatment time was changed to eight hours.

Working Example 6

A surface-hardened titanium-base material was produced in the same manner as for working example 2, except that the average grain size of the aluminum oxide powders was changed to 0.5 μm.

Working Example 7

A surface-hardened titanium-base material was produced in the same manner as for working example 2, except that the average grain size of the aluminum oxide powders was changed to 20 μm.

Working Example 8

A surface-hardened titanium-base material was produced in the same manner as for the working example 2, except that the average grain size of the aluminum oxide powders was changed to 38 μm.

Working Example 9

A surface-hardened titanium-base material was produced in the same manner as for working example 6, except that use was made of aluminum oxide powders 0.5 μm in average grain size, obtained by blending aluminum oxide powders 0.06 μm in average grain size with aluminum oxide powders 1 μm in average grain size as used in working example 1, and having a wider half width in the particle size distribution thereof than that for the aluminum oxide powders 0.5 μm in average grain size as used in working example 6.

Comparative Example 1

A surface-hardened titanium-base material was produced in the same manner as for working example 1, except that the heat treatment temperature was changed to 600° C.

Comparative Example 2

A surface-hardened titanium-base material was produced in the same manner as for working example 1, except that the heat treatment temperature was changed to 950° C.

Comparative Example 3

A surface-hardened titanium-base material was produced in the same manner as for working example 2, except that the average grain size of the aluminum oxide powders was changed to 0.06 μm.

Comparative Example 4

A surface hardened titanium-base material was produced in the same manner as for working example 2, except that the average grain size of the aluminum oxide powders was changed to 53 μm.

Comparative Example 5

A surface-hardened titanium-base material was produced in the same manner as for working example 2, except that the heat treatment atmosphere was changed to atmospheric air.

Comparative Example 6

A surface-hardened titanium-base material was produced in the same manner as for working example 2, except that the aluminum oxide powders were not used.

Comparative Example 7

The same measurements as those taken of the aforesaid working examples and other comparative examples were taken of the sintered titanium material with the mirror-like finished surface before being covered with the aluminum oxide powders for the heat treatment (that is, the titanium material yet to be treated).

The surface hardness of the surface-hardened titanium-base material produced according to working examples 1 to 9, respectively, and comparative examples 1 to 6, respectively, as well as that of the titanium material before the surface hardening treatment was applied thereto as described in comparative example 7 were measured by use of the Vickers hardness tester operating under a load of 50 gf. At the same time, visual observation was made on the surface condition of all the titanium-base materials.

Also, a scratch test was conducted on the surfaces of all the titanium-base materials described hereinbefore using a scratch tester equipped with the diamond penetrator of $\phi$0.05 mm×90° operated at a table feed rate of 75 mm/min and under a load of 50 gf in order to take measurements of the width of respective scratches.

The results of respective measurements are shown in Table 2. Further, the surfaces of all the titanium-base materials were examined by X-ray diffraction to identify phases formed in the respective surfaces.

As indicated by data for working examples 1 to 3 given in Table 2, it has been found that Vickers hardness of the surface increases as the heat treatment temperature rises, and correspondingly, the width of each scratch after the scratch test conducted on the surfaces becomes narrower, indicating that susceptibility to scratches of the surfaces of working examples is markedly improved as compared with that of the titanium material yet to be treated as described in comparative example 7, and the surfaces become substantially impervious to scratches.

It is deemed from the results of X-ray diffraction on the surfaces of the surface hardened titanium-base materials that an increase in hardness of the surfaces and reduction in the width of scratches resulting from a rise in the heat treatment temperature is due to an increase in the amount of one of the intermetallic compounds formed, a $Ti_3Al$ phase which is harder than Ti.

As shown by data for working examples 2, 4, and 5, it has been found that the Vickers hardness of the surfaces increases as the heat treatment time at a heat treatment temperature of 850° C. is lengthened, and correspondingly, the width of scratches after the scratch test becomes narrower, demonstrating that the surfaces become substantially impervious to scratches.

It is also deemed from the results of X-ray diffraction on the surfaces of the surface-hardened titanium-base materials that the above is due to an increase in the amount of the intermetallic compound formed, the $Ti_3Al$ phase which is harder than Ti. Further, it has been confirmed from the results of X-ray diffraction on the surface of the surface-hardened titanium-base material according to working examples 3 and 5 that a TiAl phase besides the $Ti_3Al$ phase was at the diffraction peak in this case, proving that effective surface hardening due to formation of the $Ti_3Al$ and TiAl phases is achieved by raising the heat treatment temperature and lengthening the heat treatment time.

Now, as is evident from comparison of working examples 1 to 3 with comparative examples 1 and 2, it will become difficult to achieve surface hardening as intended if the heating temperature is excessively low while if the heating temperature is too high, exceeding the sintering initiation temperature of the aluminum oxide powders used, the surface of the titanium-base material after the heat treatment will be adhered with the aluminum oxide powders in the form of simple particles or aggregate particles resulting from the progress in sintering thereof, causing difficulty in removal of such aluminum oxide powders as described above. As a result, it was impossible to conduct the Vickers hardness test as well as the scratch test on the surface of the titanium-base materials.

It has been found on the basis of the results described above that the heating temperature is preferably not higher than the sintering initiation temperature of the aluminum oxide powders used, and more preferably is in the range of 800 to 900° C. to efficiently achieve surface hardening as intended.

Next, as shown by data for working examples 2, and 6 to 8, it has been found that Vickers hardness of the surfaces is increased to Hv 500 or higher, and surface hardness as intended is achieved by applying the heat treatment at 850° C. for two hours using the aluminum oxide powders not more than 50 $\mu$m in average grain size.

On the other hand, as shown by data for comparative example 3, it has been found that in the case where aluminum oxide powders 0.06 $\mu$m in average grain size are used, an increase in surface hardness is attained only locally, but it becomes difficult to increase surface hardness evenly, resulting in a lower average value of Vickers hardness of the surface.

Then, as shown by data for comparative example 4, in the case that the aluminum oxide powders in excess of 50 $\mu$m (that is, 53 $\mu$m) in average grain size are used, it has been found to be difficult to increase surface hardness evenly because an increase in surface hardness attained in this case is more local than the case of comparative example 3.

As is evident from the results described above, the average grain size of the aluminum oxide powders is preferably not more than 50 $\mu$m, and more preferably in the range of 0.1 to 50 $\mu$m.

It has further been found from comparison of working example 9 with working example 6 that surface hardness is more efficiently increased even if the average grain size of the aluminum oxide powders used remains the same by use of aluminum oxide powders 0.5 $\mu$m in average grain size and having a wide half width in particle size distribution thereof, which is obtained by blending aluminum oxide powders 0.06 $\mu$m in average grain size and having a particle size distribution thereof conforming to the normal distribution with aluminum oxide powders 1 $\mu$m in average grain size and having a particle size distribution thereof conforming to the normal distribution.

As shown in comparative example 5, in the case that the heat treatment atmosphere is atmospheric air, an oxidation reaction of the surface by the agency of oxygen in the atmosphere proceeds in a pronounced manner, and an oxidized scale layer is formed on the surface of the titanium-base material. Although an increase in surface hardness is achieved, discoloring, cracks, and exfoliation of the surface-hardened layer have been observed by visual observation of scratch marks after the scratch test, indicating that the object of the invention cannot be achieved unlike the results of working example 2.

The results as described above show that the heat treatment atmosphere is preferably a pressure-reduced atmosphere, or an inert atmosphere such as argon or helium gas, to achieve the objects of the invention.

Further, as shown by data for comparative example 6, it has been found that in the case where heat treatment without use of aluminum oxide powders is applied only in an inert atmosphere, a slight increase in surface hardness was observed in comparison with the results of comparative example 7, but an increase in surface hardness, equivalent to that of working example 2, could not be achieved. The results described above demonstrate that aluminum and aluminum oxide powders as a source of supply of oxygen are required to achieve the objects of the invention.

With reference to the surface-hardened titanium-base material produced according to any of working examples 1 to 9, cracks and exfoliation of the surface were not observed at all by visual observation of scratch marks after the scratch test.

TABLE 1

| | alloy powders (at %) | average grain size (μm) | treatment temp. (° C.) | treatment time | Vickers hardness (Hv) | scratch width (μm) |
|---|---|---|---|---|---|---|
| working example 1 | 50 Al. | approx. 10 | 800 | 2 hrs. | 451 | 14.6 |
| working example 2 | 50 Al. | approx. 10 | 850 | 2 hrs. | 680 | 11.7 |
| working example 3 | 50 Al. | approx. 10 | 900 | 2 hrs. | 690 | 11.0 |
| working example 4 | 40 Al. | approx. 10 | 800 | 2 hrs. | 476 | 14.2 |
| working example 5 | 40 Al. | approx. 10 | 850 | 2 hrs. | 660 | 11.8 |
| working example 6 | 45 Al. | approx. 10 | 800 | 2 hrs. | 412 | 14.8 |
| working example 7 | 45 Al. | approx. 10 | 850 | 2 hrs. | 616 | 12.1 |
| working example 8 | 30 Al. | approx. 10 | 850 | 2 hrs. | 620 | 12.1 |
| working example 9 | 70 Al. | approx. 10 | 850 | 2 hrs. | 598 | 12.4 |
| working example 10 | 50 Al. | approx. 30 | 850 | 2 hrs. | 403 | 15.3 |
| comp. example 1 | 15 Al. | approx. 10 | 850 | 2 hrs. | 301 | 19.8 |
| comp. example 2 | 80 Al. | approx. 10 | 850 | 2 hrs. | unable to measure | unable to measure |
| comp. example 3 | 50 Al. | approx. 50 | 850 | 2 hrs. | 331 | 18.5 |
| comp. example 4 | 50 Al. | approx. 10 | 600 | 2 hrs. | 354 | 18.4 |
| comp. example 5 | 50 Al. | approx. 10 | 950 | 2 hrs. | unable to measure | unable to measure |
| comp. example 6 | none | | | | 232 | 20.4 |

TABLE 2

| | average grain size (μm) | treatment temp. (° C.) | treatment time | Vickers hardness (Hv) | scratch width (μm) | surface appearance |
|---|---|---|---|---|---|---|
| working example 1 | 1 | 800 | 2 hrs. | 511 | 14.0 | good |

TABLE 2-continued

| | average grain size (μm) | treatment temp. (° C.) | treatment time | Vickers hardness (Hv) | scratch width (μm) | surface appearance |
|---|---|---|---|---|---|---|
| working example 2 | 1 | 850 | 2 hrs. | 665 | 12.5 | good |
| working example 3 | 1 | 900 | 2 hrs. | 739 | 10.1 | good |
| working example 4 | 1 | 850 | 4 hrs. | 702 | 10.9 | good |
| working example 5 | 1 | 850 | 8 hrs. | 727 | 10.2 | good |
| working example 6 | 0.5 | 850 | 2 hrs. | 586 | 13.1 | good |
| working example 7 | 20 | 850 | 2 hrs. | 608 | 12.8 | good |
| working example 8 | 38 | 850 | 2 hrs. | 521 | 13.9 | good |
| working example 9 | 0.5 | 850 | 2 hrs. | 668 | 12.6 | good |
| comp. example 1 | 1 | 600 | 2 hrs. | 294 | 19.0 | good |
| comp. example 2 | 1 | 950 | 2 hrs. | unable to measure | unable to measure | poor adhesion |
| comp. example 3 | 0.06 | 850 | 2 hrs. | 340 | 18.1 | good |
| comp. example 4 | 53 | 850 | 2 hrs. | 327 | 18.6 | good |
| comp. example 5 | 1 | 850 | 2 hrs. | unable to measure | unable to measure | discoloring/exfoliation |
| comp. example 6 | N/A (no alloy powders) | 850 | 2 hrs. | 250 | 20.0 | good |
| comp. example 7 | unprocessed | — | — | 232 | 20.4 | good |

INDUSTRIAL APPLICABILITY

The surface-hardened titanium-base material produced by the method of surface hardening a titanium material has a hard surface excellent in wear resistance and scratch resistance.

In particular, the surface-hardened titanium-based material has excellent ductility as compared with an ordinary Ti—Al based alloy material because the Ti—Al based intermetallic compounds are formed only immediately underneath the surface thereof while pure titanium is present in the interior zone thereof. Furthermore, the surface thereof is formed not of an oxidized coating but of the Ti—Al based intermetallic compounds with the percentage of aluminum concentration declining by a gradient towards the intenor. Hence, the surface thereof can maintain a metallic color, and is impervious to exfoliation. Also, the surface is not prone to cause metallic allergy even if the same comes into direct contact with human skin.

Therefore, when the same is used as a material for various metal products, the high quality external appearance thereof can be kept for a long duration. Particularly, when the surface-hardened titanium-base material is used for decorative articles and the watchcases, and the like, which are worn by users, products impervious to scratches and which are unlikely to cause metallic allergy to the skin of the users can be provided.

What is claimed is:

1. A surface-hardened titanium-base material wherein a first phase composed of TiAl, a second phase composed of TiAl and $Ti_3Al$, a third phase composed of $Ti_3Al$, and a fourth phase composed of $Ti_3Al$ and Ti are formed sequentially from a surface towards interior zone of pure titanium material, such that a percentage of aluminum in relation to pure titanium declines sequentially by a gradient from the surface to the interior zone of the pure titanium material.

2. A method of surface hardening a titanium material, comprising bringing only titanium-aluminum alloy powders containing not lower than 30 at % but not higher than 70 at % of aluminum and having an average grain size of not greater than 30 $\mu$m into contact with a surface of a pure titanium material, and applying a heat treatment thereto at a temperature within the range of 800° C. to 900° C., so as to form a first phase composed of TiAl, a second phase composed of TiAl and $Ti_3Al$, a third phase composed of $Ti_3Al$, and a fourth phase composed of $Ti_3Al$ and Ti sequentially from the surface towards an interior zone of the pure titanium material, such that a percentage of aluminum in relation to pure titanium is caused to decline sequentially by a gradient from the surface to the interior zone of the pure titanium material.

3. A surface-hardened titanium-base material wherein a first phase composed of TiAl, a second phase composed of TiAl and $Ti_3Al$, a third phase composed of $Ti_3Al$, and a fourth phase composed of $Ti_3Al$ and Ti are formed sequentially from a surface towards an interior zone of pure titanium material, such that a percentage of aluminum in relation to pure titanium declines sequentially by a gradient from the surface to the interior zone of the pure titanium material, and oxygen concentration also declines sequentially by gradient from the surface to the interior zone of the pure titanium material.

4. A method of surface hardening a titanium material, comprising bringing only aluminum oxide ($Al_2O_3$) powders having an average grain size in the range of 0.1 to 50 $\mu$m into contact with a surface of a pure titanium material, and applying a heat treatment thereto at a temperature within the range of 800° C. to 900° C. and in a reduced-pressure atmosphere of an inert gas, so as to form a first phase composed of TiAl, a second phase composed of TiAl and $Ti_3Al$, a third phase composed of $Ti_3Al$, and a fourth phase composed of $Ti_3Al$ and Ti sequentially from the surface towards an interior zone of the pure titanium material, such that a percentage of aluminum in relation to pure titanium declines sequentially by a gradient from the surface to the interior zone of the pure titanium material, and oxygen concentration also declines sequentially by gradient from the surface to the interior zone of the pure titanium material.

* * * * *